US006564726B1

(12) United States Patent
Lindskog

(10) Patent No.: US 6,564,726 B1
(45) Date of Patent: May 20, 2003

(54) METHOD AND DEVICE FOR MARKING OF OBJECTS

(75) Inventor: Kjell Lindskog, Skellefteå (SE)

(73) Assignee: SQS Security Qube System AB, Skelleftea (SE)

( * ) Notice: Subject to any disclaimer, the term of this patent is extended or adjusted under 35 U.S.C. 154(b) by 0 days.

(21) Appl. No.: 09/721,050

(22) Filed: Nov. 22, 2000

Related U.S. Application Data

(63) Continuation-in-part of application No. PCT/SE99/00866, filed on May 20, 1999.

(30) Foreign Application Priority Data

May 22, 1998 (SE) ..... 9801849

(51) Int. Cl.[7] ..... E05G 1/00
(52) U.S. Cl. ..... 109/25
(58) Field of Search ..... 109/25, 29–34

(56) References Cited

U.S. PATENT DOCUMENTS

| | | | | | |
|---|---|---|---|---|---|
| 1,606,258 | A | * | 11/1926 | Morssen | 109/25 |
| 1,808,248 | A | | 6/1931 | Morssen | 109/25 |
| 2,035,498 | A | | 3/1936 | Navis et al. | 109/25 |
| 3,688,708 | A | | 9/1972 | Meyerhoefer | 109/29 |
| 3,851,602 | A | | 12/1974 | Lamping | 109/23 |
| 4,607,579 | A | * | 8/1986 | Stenild | 109/25 |
| 5,156,272 | A | * | 10/1992 | Bouchard et al. | 206/495 |
| 5,485,143 | A | * | 1/1996 | Keniston | 340/568 |
| 5,732,638 | A | * | 3/1998 | Van Lint | 109/29 |

FOREIGN PATENT DOCUMENTS

| | | | | |
|---|---|---|---|---|
| GB | 2 006 322 A | * | 8/1977 | |
| GB | 2006322 | | 5/1979 | |
| GB | 2269205 | | 2/1994 | |
| WO | WO 99/61741 | * | 5/1999 | E05G/1/14 |

* cited by examiner

*Primary Examiner*—Robert J. Sandy
*Assistant Examiner*—Ruth C. Rodriguez
(74) *Attorney, Agent, or Firm*—Nils H. Ljungman & Associates

(57) ABSTRACT

Method and device (10) for marking objects (100), particularly for marking objects in banknote cassettes (1) or in other valuable object storage spaces. There is used a container (60) which can be punctured or otherwise opened and which is placed adjacent the object/objects (100) to be marked. The device includes means (13) which is caused to puncture or otherwise open the container (60) when necessary, so as to enable the content (61) of the container to come into contact with the object/objects (100) and therewith mark said object/objects and/or render the same useless. The marking device (10) and the container (60) fitted thereto are placed in the upper region of the space (1) so that the container is able to come into contact with said object/objects (100) at least partially with the aid of gravity. The puncturing means/opening means (13) is released from an active rest position when an alarm is triggered, so as to slit or otherwise open the container (60) in a guillotine fashion.

16 Claims, 5 Drawing Sheets

METHOD AND DEVICE FOR MARKING OF OBJECTS

CONTINUATION APPLICATION DATA

This application is a Continuation-In-Part Application of International Patent Application No. PCT/SE99/00866, filed on May 20, 1999, which claims priority from Sweden Patent Application No. 9801849-2, filed on May 22, 1998. International Patent Application No. PCT/SE99/00866 was pending as of the filing date of the above-cited application. The United States was an elected states in International Patent Application No. PCT/SE99/00866.

BACKGROUND OF THE INVENTION

1. Field of the Invention

The present invention relates to an object marking method, particularly related to banknote cassettes or other valuable object storage spaces. The invention also relates to a device for carrying-out the method and to the use of such a device.

2. Background of the Invention

In connection with so-called dispensing machines, such as cash dispensers, automatic telling machines, and the like, there is a need for equipment that will stain banknotes if an attempt is made to steal the contents of the machine. These attempts may be made, e.g., by blowing open the cash dispenser, breaking open the dispenser or by cutting open the dispenser with the aid of a gas cutting appliance.

OBJECT OF THE INVENTION

One object of the present invention is to provide a method and a device which, when necessary, will mark objects stored in banknote cassettes or other types of valuable object storages in a particularly effective manner. This object is achieved with the method and the device that have the characteristic features set forth hereinbelow.

SUMMARY OF THE INVENTION

The following advantages are among those afforded by the present invention.

The inventive method and inventive device cause the liquid container to be punctured or otherwise opened, so that the liquid content of the container will come into contact with the object/objects and therewith mark the object/objects and/or render said object/objects unusable in a particularly effective manner.

For instance, a slot is made along the full length of the container that contains the destructive agent, so that said agent is able to run out gravitationally over the bundle of banknotes for instance.

The inventive device can be given any desired size and is adapted to desired requirement specifications.

The inventive device can be readily adapted to suit existing pay machines, automatic telling machines, banknote dispensing machines, and like machines. The inventive method and inventive device can also be used in other equipments when, for instance, drop-staining or spray-staining is desirable.

The inventive device has both technical and economical advantages.

The above-discussed embodiments of the present invention will be described further hereinbelow. When the word "invention" is used in this specification, the word "invention" includes "inventions", that is, the plural of "invention".

By stating "invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

The invention will now be described in more detail with reference to exemplifying embodiments thereof and also with reference to the accompanying drawings, in which

FIG. 7 shows the device in a safe or unarmed state and FIG. 8 shows the device in an armed state;

DESCRIPTION OF THE PREFERRED EMBODIMENT

Figure 2:
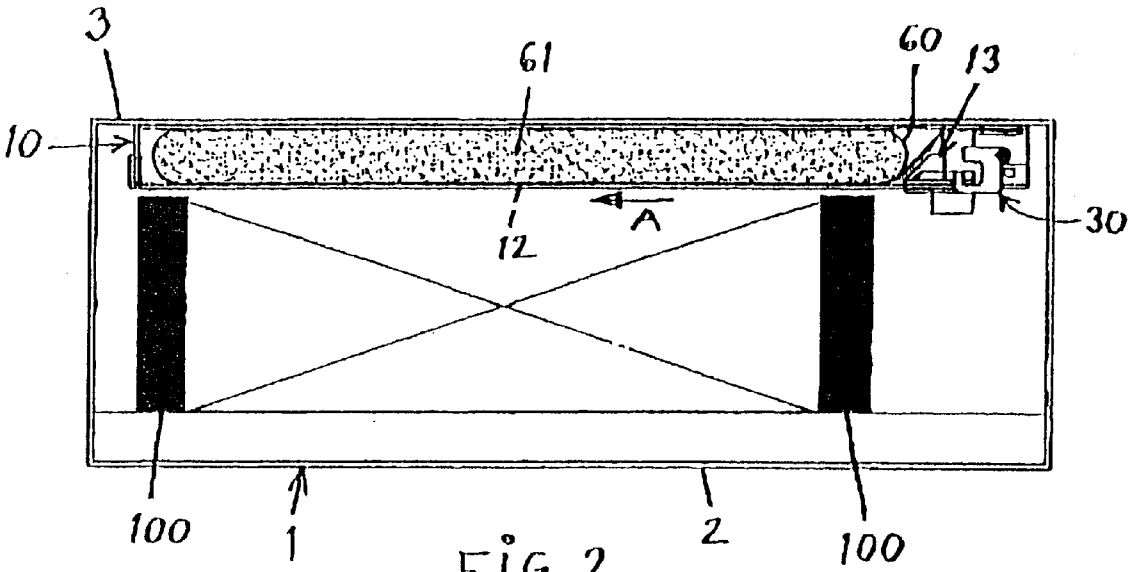
FIG. 2 is a sectional and schematic longitudinal view of the inventive device fitted in a banknote cassette.
Figure 1:
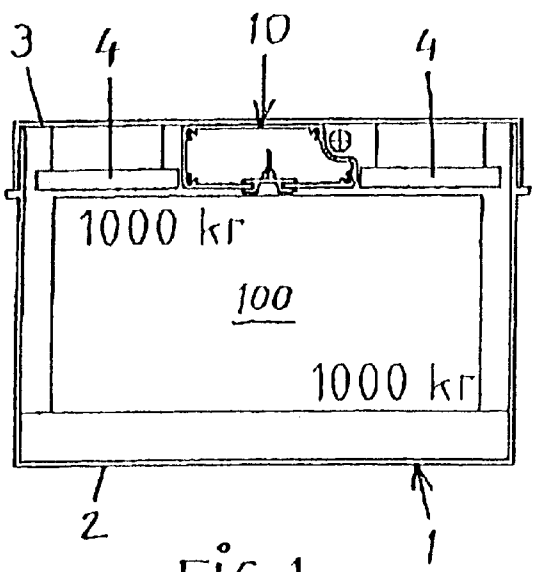
FIG. 1 is a cross-sectional, schematic view of the inventive device fitted in a banknote cassette.

FIGS. 1 and 2 illustrate the inventive device 10 fitted to a so-called banknote cassette 1 filled with a bundle of banknotes 100. The illustrated cassette comprises a box-shaped bottom part 2 and a cover 3. The underside of the cover, or lid, 3 includes guide bars 4 which ensure correct orientation and alignment of the banknotes in the cassette 1; Although not shown, the cassette 1 normally includes a spring-biased banknote dispenser arrangement. Such banknote cassettes 1 are filled with banknotes and used, e.g., in cash dispensers, automatic telling machines, pay machines and like machines.

The inventive device 10 is designed to be fitted beneath the cover 3 of a banknote cassette 1. The marking mechanism of the device 10 is armed in conjunction with fitting said device into the cassette.

The marking device 10 includes a casing 11, which is preferably an extruded structure and which includes a longitudinally extending slot 12 in the bottom thereof, as will be best seen from FIGS. 3–8.

The marking device 10 also includes a carriage-mounted cutting device 13 which is adapted to slide along the slot or slit 12 whilst guided by two guides 14. The cutter 13 has a rearwardly sloping cutting edge 15 on its front end. The cutter 13 also includes a hole 16 whose function will be described more explicitly below.

A wire or cord 20 is secured to the cutter/opening device 13 at an attachment point 21 and the cord 20 runs from said anchoring point 21 along said slot 12. The wire or cord 20 is deflected around two bushings 22 and 23 provided in a removable end wall 17, and thereafter deflected at a deflecting ring 24 and then anchored relative to the profiled casing 11 in the proximity of the end wall 17. The pattern in which the wire or cord is drawn through the device will best be seen from FIG. 3, from which it will also be seen that the wire deflecting ring 24 is connected to a first end 25 of a pull spring 26 whose other end 27 is anchored relative to the casing 11 at the rear end 18 of the casing. The object marking device 10 also includes a release mechanism/locking mechanism 30 which is adapted to hold the puncturing device/opening device/cutter 13 in an inactive starting position and which functions to release the cutting device when an alarm is triggered.

Figures 3, 4, 5, 6, 7, 8:
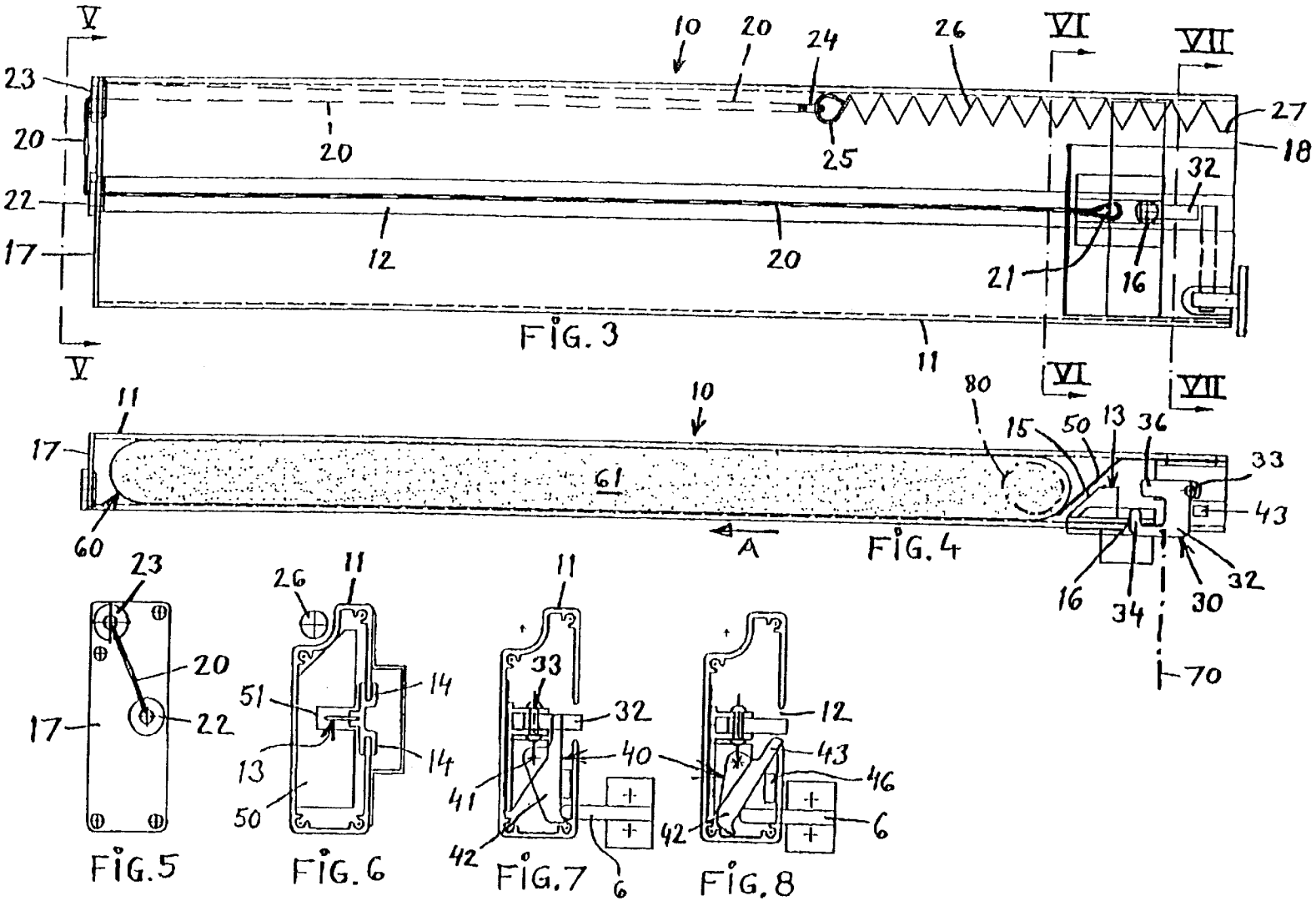
FIG. 3 is a schematic view of the inventive device from beneath.
FIG. 4 is a broken, schematic longitudinal view of the inventive device.
FIG. 5 is a schematic end view of the device taken on the line V—V in FIG. 3.
FIG. 6 is a schematic sectioned view taken on the line VI—VI in FIG. 3.
FIGS. 7 and 8 are respective schematic sectioned views taken on the line VII—VII in FIG. 3, wherewith

The locking mechanism/release mechanism 30 includes a pivotal release rocker 32. The release rocker 32 is pivotally mounted on a pivot point 33 and includes a knife holder pin 34 which is insertable into the hole 16 of the knife means 13, as shown in FIG. 4. The release rocker 32 also includes a balance weight 36 which determines the release level or the release sensitivity of the release mechanism. The configuration of the pivot pin and its angle of inclination can be adapted so as to obtain the release sensitivity desired.

As evident from the Figures, the pull spring 26 is disposed on the outside of the casing 11.

The device 10 also includes a safety mechanism 40 for avoiding unintentional activation of the object marking device 10 in conjunction with moving or transporting said device at a distance from its place of use, in other words when the marking device 10 is not placed in a banknote cassette 1 for instance.

The safety mechanism 40 includes a safety rocker 42 which is pivotally mounted on a pivot point 41 and which includes a tongue 43 which in its safety position lies behind the release rocker 32 and therewith prevents the rocker from pivoting to a release position, in other words from releasing its engagement with the cutter 13. This safety position is shown in FIG. 7. FIG. 8, on the other hand, shows the safety mechanism 40 in a non-safe or armed state, in which an arming pin 6 provided in the cassette 1 has moved the safety rocker 42 to the position shown in FIG. 8, in which the tongue 43 has left its position behind the release rocker 32 so that it can now pivot to enable the pin 34 to release its engagement with the cutter 13. If desired, a permanent magnet 46 or a spring may be fitted so as to ensure, with a desired force, that the safety rocker 42 will not be moved from its safety position unintentionally or accidentally before the arming pin 6 has armed the marking device 10 as it is placed finally in its position of use in the cassette 1.

A protective plate 50 is mounted within the casing 11 so as to prevent a container 60 placed in the casing from coming into abutment with the knife edge 15 when the cutter 13 is located its starting position, as shows in FIG. 4. As will be seen from FIG. 6, the protective plate 50 has a recess 51 which enables the cutter 13 to pass by the protective plate 50 when an alarm is triggered.

The container 60 may, for instance, have the form of a plastic foil-casing, which is filled with a destructive agent 61. The destructive agent 61 may comprise a liquid or a stain comprised of strong colors, so that desired staining/destruction of the banknotes 100 in the cassette 1 can be accomplished when required or necessary. The container 60 may thus consist of a plastic foil hose which is sealed at both ends and filled with a liquid that is appropriate in the present context.

The inventive object marking device 10 operates in the following way.

The marking device 10 is charged with a liquid-filled container 60, by removing temporarily the detachable end wall 17 for instance. In this stage, the cutter 13 is located in its rear inactive position and the release mechanism 30 is in firm locking engagement with the center. The end wall 17 is then replaced in its normal position and the pull spring 26 is placed under tension. The release mechanism 30 is made safe by means of the safety mechanism 40.

The marking device 10 duly charged with a liquid container 60 and armed in the aforedescribed manner is now fitted beneath the cover 3 of a banknote-filled cassette 1, with the arming pin 6 of the cassette functioning to arm the marking device 10 when it is located within said cassette. The cassette 1 is then placed in a pay machine, automatic telling machine, automatic cash dispenser or the like.

The device will operate in the following manner in the event of an unlawful attack on the machine.

If an attempt is made to enter the machine with the aid of an explosive for instance, the release mechanism 30 will be actuated so as to cause the knife holder pin 34 to move out of engagement with the cutter 13 and therewith release the cutter for movement along the slot 12 under the action of the pull spring 26, in the direction of the arrow A. The knife edge 15 will therewith work forwards through the container 60, in the manner of a guillotine, so as to form an elongated slit in said container through which the liquid content of said container are able to run over the banknotes under the force of gravity, and therewith stain the banknotes 100 and render them useless by virtue of being stained or marked.

The container 60 is thus emptied of its stain content/liquid content relatively quickly and very effectively.

In the case described, the marking device 10 is triggered by vibrations occurring as a result of the explosion, therewith destroying the banknotes.

However, alternative release mechanisms that react to attempts to force open such machines with which no such vibrations occur are possible within the scope of the invention. One example in this regard is a release mechanism that includes a wire system 70 which is adapted to actuate the release mechanism 30 in response to a rise in temperature for instance, caused by attacking the machine with a cutting torch or in some other way. Such a wire system 70 is indicated in chain lines in FIG. 4.

Figure 9:
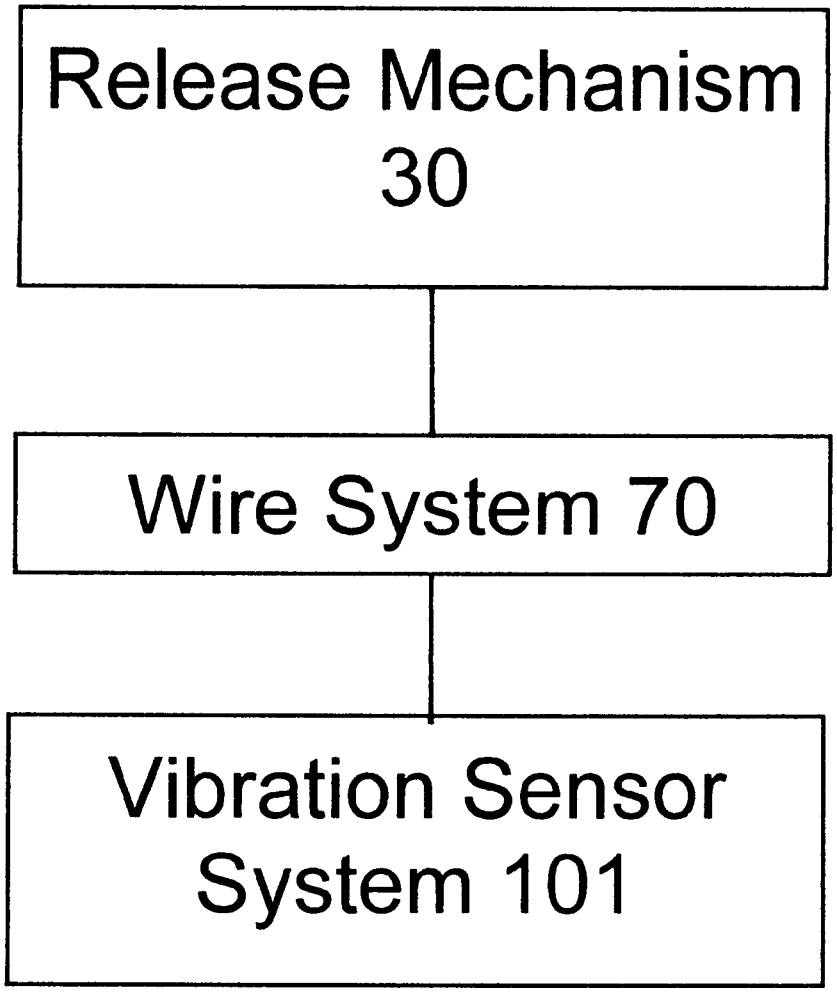
FIG. 9 shows a box diagram of a vibration sensor system operatively connected to the release mechanism according to at least one possible embodiment of the present invention.

In at least one possible embodiment of the present invention as shown in FIG. 9, the release mechanism 30 can be connected by the wire system 70 to a vibration sensor system 101. The vibration sensor system 101 actuates the release mechanism 30 upon sensing a forceful vibration, such as would be caused by an explosion or other forced entry as discussed above.

Figure 10:
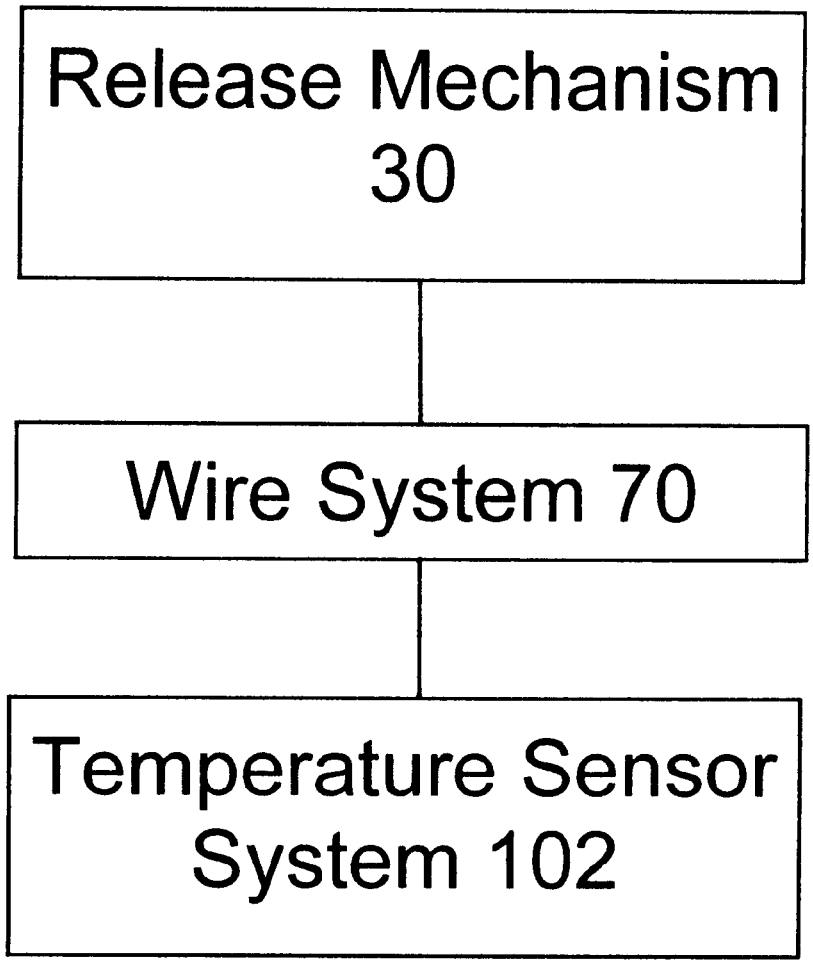
FIG. 10 shows a box diagram of a temperature sensor system operatively connected to the release mechanism according to at least one possible embodiment of the present invention.

In at least one other possible embodiment of the present invention shown in FIG. 10, the release mechanism 30 can be connected by the wire system 70 to a temperature sensor system 102. The temperature sensor system 102 actuates the release mechanism 30 upon sensing a substantial rise in temperature, such as would be caused by a cutting torch as discussed above.

Figure 11:
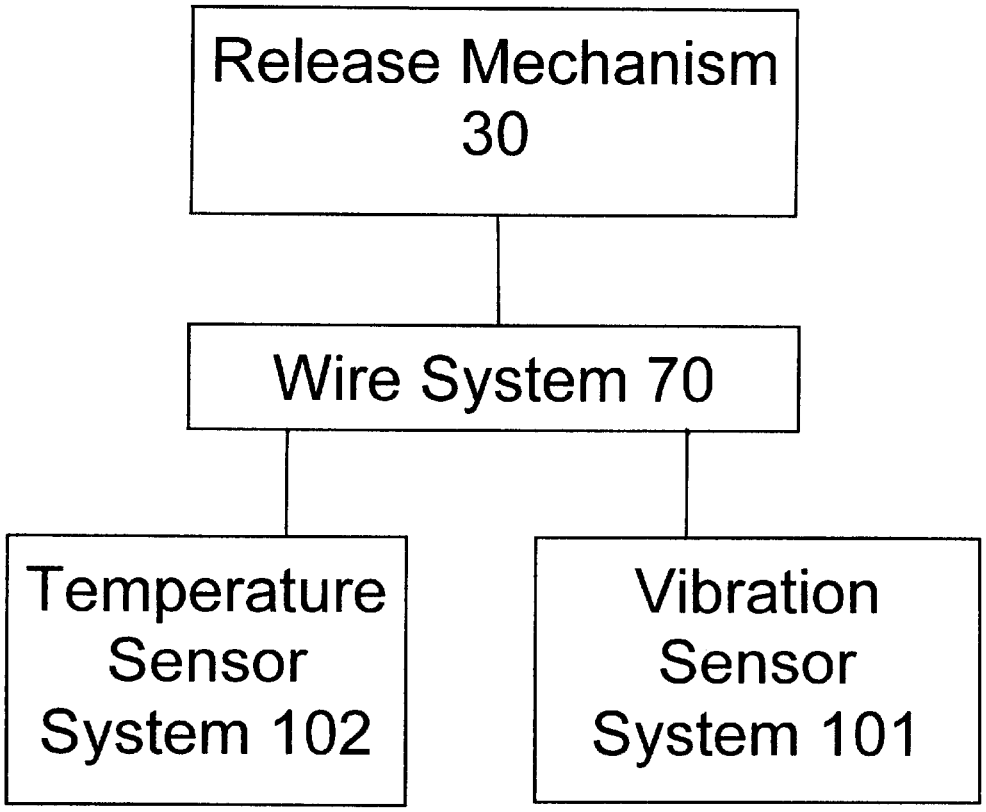
FIG. 11 shows a box diagram of the vibration sensor system and the temperature sensor system both operatively connected to the release mechanism according to at least one possible embodiment of the present invention.

In yet another possible embodiment of the present invention shown in FIG. 11, the release mechanism 30 can be connected by the wire system 70 to both the vibration sensor system 101 and the temperature sensor system 102. Either one of the vibration sensor system 101 or the temperature sensor system 102 can actuate the release mechanism 30 upon sensing a substantial vibration or rise in temperature.

It can be mentioned that the pulling force of the spring 26 is at a maximum when the container 60 is punctured initially, which is, of course, highly beneficial. The arrangement of the line 20 and the spring arrangement may, of course, be varied within the scope of the invention.

The transmission achieved with the illustrated line path is sufficient to ensure that the cutter will execute an effective working stroke. The spring is normally stretched or extended manually.

A roller or plunger 80 functioning to forcibly empty the container 60 of its liquid content may be provided adjacent the container 60 or within said container 60 at its rear end, said plunger 80 being moved forward under the influence of the cutter 13 as the knife slide is pulled in the direction of arrow A when an alarm is triggered.

It should be mentioned that the container 60 may have a relatively stable construction, provided that it has a weakening which will enable the cutter 13 to puncture the container 60 in a guillotine fashion in the region of forward movement of the knife edge 15. A more stable container construction will, of course, simplify fitting of the container into the marking device 10.

It will be understood that the structural design of the inventive device 10 can be modified and varied in several ways.

For instance, the described and illustrated components can be replaced with functionally equivalent components. Changes in cutter design and in the design of the knife slide may also be made, as may also changes to the way in which the line, e.g. the wire or cord, is drawn and the spring arrangement. The release mechanism and the safety mechanism may, of course, also be varied in many different ways other than that illustrated.

It will be noted that the inventive device in its fundamental form is completely free of electronic devices and is based on mutual coaction between mechanical components.

The invention is thus not restricted to the illustrated and described embodiments thereof, since changes and modifications can be made within the scope of the following claims.

One feature of the invention resides broadly in a method of marking objects, particularly related to banknote cassettes (1) or other valuable object storage spaces, characterized by placing a container (60) that can be punctured or otherwise opened adjacent said object/objects (100); causing a device (13) to puncture or otherwise open said container (60) when required so as to bring the content (61) of said container into contact with the object/objects (100) and therewith mark said object/objects and/or render said object/objects unusable.

Another feature of the invention resides broadly in a method characterized by placing the container (60) in the upper region of the space (1) so that the container content (61) will be brought into contact with said object/objects (100) at least partially by the force of gravity.

Yet another feature of the invention resides broadly in a method characterized by causing the puncturing device/opening device (13) to be released from an inactive rest position in response to an alarm and therewith slit or otherwise open the container (60).

Still another feature of the invention resides broadly in a method characterized by instigating release of said puncturing/opening device (13) on the basis of vibrations and/or temperature.

A further feature of the invention resides broadly in a device for marking objects, particularly objects housed in banknote cassettes (1) or any other valuable object storage spaces, characterized in that the marking device (10) includes a container (60) which can be punctured or otherwise opened and which is placed adjacent said objects (100); and in that the device includes a means (13) which is caused to puncture or otherwise open the container (60) when necessary, such as to enable the contents (61) of the container to come into contact with said object/objects (100) and therewith mark said object/objects and/or render said object/objects useless.

Another feature of the invention resides broadly in a device characterized in that the means (13) for puncturing/opening said container includes a cutting edge (15); and in that said means (13) can be moved from an inactive starting position to an active terminal position whilst puncturing/opening said container (60) as said means moves forwards (A).

Yet another feature of the invention resides broadly in a device characterized by spring means (26) which exert force on the puncturing/opening means (13) such as to cause said puncturing means/opening means to move in said forward direction (A).

Still another feature of the invention resides broadly in a device characterized in that the device (10) includes a release mechanism (30) which is adapted to hold the puncturing means/opening means (30) in its inactive starting position; and in that said device includes means which eliminate the ability of the release mechanism (30) to hold said puncturing means/opening means (30) in said inactive starting position when an alarm is triggered.

A further feature of the invention resides broadly in a device characterized in that the container (60) contains a liquid (61), in that the container (60) is made of plastic foil; and in that said device (10) includes means (80) for forcibly emptying the container (60) of its liquid content.

Another feature of the invention resides broadly in the use of a device characterized by using said device (10) in connection with paying machines, automatic telling machines, automatic cash dispensers or like machines, to drop-stain or spray-stain banknotes (100) or like valuables.

The components disclosed in the various publications, disclosed or incorporated by reference herein, may be used in the embodiments of the present invention, as well as, equivalents thereof.

The appended drawings in their entirety, including all dimensions, proportions and/or shapes in at least one embodiment of the invention, are accurate and to scale and are hereby included by reference into this specification.

All, or substantially all, of the components and methods of various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding international patent publication application, namely, International Application No. PCT/

SE99/00866, filed on May 22, 1998, having inventor Kjell Lindskog, as well as its published equivalents, if any, and corresponding Swedish Patent Application 9801849-2, filed on May 22, 1998, having inventor Kjell Lindskog, and other equivalents or corresponding applications, if any, in corresponding cases in Sweden and elsewhere, and the references cited in any of the documents cited herein, are hereby incorporated by reference as if set forth in their entirety herein.

The following U.S. patents and patent applications are incorporated by reference herein: Ser. No. 08/336,579, having inventor Lindskog, filed on Nov. 9, 1994; Ser. No. 08/696,136, having inventor Lindskog, filed on Aug. 13, 1996; Ser. No. 5,775,235, having inventors Lindskog, et al., issued on Jul. 7, 1998; Ser. No. 09/227,427, having inventors Lindskog, et al., filed on Jan. 8, 1999; and Ser. No. 09/118, 355, having inventor Lindskog, filed on Jul. 7, 1998.

The details in the patents, patent applications and publications may be considered to be incorporable, at applicant's option, into the claims during prosecution as further limitations in the claims to patentably distinguish any amended claims from any applied prior art.

Some examples of alarms, alarm devices, or alarm circuits or components thereof, which could possibly be utilized or adapted for use in one embodiment of the present invention can be found in the following U.S. Patents: U.S. Pat. No. 5,831,531, issued on Nov. 3, 1998 to inventor Tuttle; U.S. Pat. No. 5,775,235, issued on Jul. 7, 1998 to inventors Lindskog, et al; U.S. Pat. No. 5,686,909, issued on Nov. 11, 1997 to inventor Steinhauser; U.S. Pat. No. 5,554,833, issued on Sep. 10, 1996 to inventor Johnson; U.S. Pat. No. 5,548,915, issued on Aug. 27, 1996 to inventors Szarmach, et al.; U.S. Pat. No. 5,191,314, issued on Mar. 2, 1993 to inventors Ackerman, et al.; U.S. Pat. No. 4,300,130, issued on Nov. 10, 1981 to inventors Fotheringham, et al.; and U.S. Pat. No. 3,967,239, issued on Jun. 29, 1976 to inventor Steele.

Some examples of explosive devices or explosive substances which could possibly be utilized or adapted for use in one embodiment of the present invention can be found in the following U.S. Patents: U.S. Pat. No. 5,775,235, issued on Jul. 7, 1998 to inventors Lindskog, et al.; U.S. Pat. No. 5,600,086, issued on Feb. 4, 1997 to inventor Lemmonier; U.S. Pat. No. 5,537,938, issued on Jul. 23, 1996 to inventor Lopez, Jr.; U.S. Pat. No. 5,505,631, issued on Apr. 9, 1996 to inventors Schauer, et al.; U.S. Pat. No. 5,503,077, issued on Apr. 2, 1996 to inventor Motley; U.S. Pat. No. 5,485,788, issued on Jan. 23, 1996 to inventor Corney; U.S. Pat. No. 5,485,143, issued on Jan. 16, 1996 to inventor Keniston; U.S. Pat. No. 5,196,828, issued on Mar. 23, 1993 to inventor Keniston; U.S. Pat. No. 5,035,843, issued on Jul. 30, 1991 to inventor Schmid; U.S. Pat. No. 4,942,831, issued on Jul. 24, 1990 to inventor Tel; U.S. Pat. No. 4,884,507, issued on Dec. 5, 1989 to inventor Levy; U.S. Pat. No. 4,853,676, issued on Aug. 1, 1989 to inventor Kitts.; U.S. Pat. No. 4,852,502, issued on Aug. 1, 1989 to inventors Klingberg, et al.; U.S. Pat. No. 4,799,435, issued on Jan. 24, 1989 to inventor Boutroy; U.S. Pat. No. 4,712,489, issued on Dec. 15, 1987 to inventor Levavasseur; U.S. Pat. No. 4,607,579, issued on Aug. 26, 1986 to inventor Stenild; U.S. Pat. No. 4,236,463, issued on December 2 to inventor Westcott; U.S. Pat. No. 4,202,445, issued on May 13, 1980 to inventor Porter; U.S. Pat. No. 4,025,369, issued on May 24 to inventors Price, et al.; U.S. Pat. No. 3,904,451, issued on Sep. 9, 1975 to inventor Rainone; U.S. Pat. No. 3,676,945, issued on Jul. 18, 1972 to inventor Neanhouse; U.S. Pat. No. 3,643,609, issued on Feb. 22, 1972 to inventor Maywald; U.S. Pat. No. 3,303,592, issued on Feb. 14, 1967 to inventor Harner; U.S. Pat. No. 1,743,941, issued on Jan. 14, 1930 to inventor Van Factor; U.S. Pat. No. 1,646,687, issued on Oct. 25, 1927 to inventor Daly.

Some examples of dye for security reasons which could possibly be utilized or adapted for use in one embodiment of the present invention can be found in the following U.S. Patents: U.S. Pat. No. 5,264,410, entitled "Security Laminates"; U.S. Pat. No. 5,196,828, entitled "Bendable Currency Security Dye Pack".

Some examples of laminates which could possibly be utilized or adapted for use in one embodiment of the present invention can be found in the following U.S. Patents: U.S. Pat. No. 5,285,734, entitled "Security Enclosures"; U.S. Pat. No. 5,216,854, entitled "Laminated Panel Modular Building Structure and Assembly Method".

Some examples of optical fibers which could possibly be utilized or adapted for use in one embodiment of the present invention can be found in the following U.S. Patents: U.S. Pat. No. 5,202,673, entitled "Security Method and Apparatus"; U.S. Pat. No. 5,185,845, entitled "Optical Fiber Closure Having Enchanced Storage Capability"; U.S. Pat. No. 5,189,725, entitled "Optical Fiber Closure"; U.S. Pat. No. 5,182,785, entitled "High-Flex Optical Fiber Coil Cables"; U.S. Pat. No. 5,274,726, entitled "Optical Fiber Units and Optical Cables"; and U.S. Pat. No. 5,284,346, entitled "Game Appartus".

The following U.S. Patents are hereby incorporated by reference as if set forth in their entirety herein: U.S. Pat. No. 3,763,795, issued October 1973 to Wetz, Jr.; U.S. Pat. No. 4,523,528, issued June 1985 to Hastings et al.; U.S. Pat. No. 5,677,674, issued October 1997 to Wolf; U.S. Pat. No. 4,558,308, issued Dec. 1985 to Giordinik et al.; U.S. Pat. No. 5,152,508, issued October 1992 to Fish; U.S. Pat. No. 181,078, issued August 1876 to Larned; U.S. Pat. No. 206,182, issued July 1878 to Koloseus; U.S. Pat. No. 362,010 issued April 1887 to Jewill; U.S. Pat. No. 708,093, issued September 1902 to Sutton et al.; U.S. Pat. No. 1,097,587, issued May 1914 to Hammond; U.S. Pat. No. 1,920,742, issued August 1933 to Chapman et al.; U.S. Pat. No. 4,389,948, issued June 1983 to Sands et al.; U.S. Pat. No. 4,799,435, issued Jan. 1, 1989 to Boutroy, U.S. Pat. No. 4,852,502, issued Aug. 1989 to Klingberg et al.; U.S. Pat. No. 5,285,734, issued February 1994 to MacPherson; U.S. Pat. No. 4,681,591, issued July 1987 to Okayasu et al.; and U.S. Pat. No. 880,020, issued February 1980 to Grass.

The following foreign patents are hereby incorporated by reference as.if set forth in their entirety herein: Federal Republic of Germany Patent Application Numbers 2747285, issued April 1979; 3028399, issued February 1982; 2745178, issued April 1978; and 3234583, issued May 1983; International Patent Application Number 9322751, issued November 1993; Swiss Patent Application Number 280337, issued April 1952; French Patent Application Number 2497981, issued July 1982, Great Britain Patent Application Numbers 2199890, issued July 1988; and 1375926, issued December 1974; Denmark Patent Application Numbers 0159586, issued November 1990; and 0149274, issued April 1986; Swedish Patent Application Number 0409481, issued August 1979; and European Patent Application Number 0039371, issued November 1981.

The corresponding foreign and international patent publication applications, namely, Sweden Patent Application No. 9602732-1, filed Jul. 10, 1996, having inventors Kjell LINDSKOG and Ola FRISTRÖM, Sweden Patent Application No. 9401340-6, filed Apr. 19, 1994, having inventors Kjell LINDSKOG and Ola FRISTRÖM, and Laid-open Swedish Patent Application No. 9602732.1, if any, and published Swedish Patent Application No. 9602732.1, if any, and Sweden Patent Application No. 421548, published Jan. 4, 1982, having inventor Heuer, and Sweden Patent Application No. 436440, published Dec. 10, 1984, having inventor Sök, and International Application No. PCT/SE97/01237, filed Jul. 6, 1997, International Application No. PCT/SE95/00418, filed Apr. 18, 1995, and International Publication No. WO 98/01646 published on Jan. 15, 1998, and International Publication No. WO 95/28542 published on Oct. 26, 1995, International Publication No. WO83/073872 published on Nov. 10, 1983, and International Publication No. WO81/00043 published on Jan. 22, 1981, Denmark Patent Application No. 165915, published on Feb. 8, 1993, Great Britain Patent Application No. 849396, published on Sep. 28, 1960, Great Britain Patent Application No. 731877, published on Jun. 15, 1955, France Patent Application No. 2382211, published on Sep. 29, 1978, France Patent Application No. 1356660, published on Mar. 27, 1964, France Patent Application No. 976235, published on Mar. 15, 1951, France Patent Application No. 458464, published on Oct. 11, 1913, EP Patent Application No. 0109984, published on Jun. 13, 1985, and EP Patent Application No. 0159229, published on Oct. 23, 1985, as well as their published equivalents, and other equivalents or corresponding applications, if any, in corresponding cases in Sweden and elsewhere, are hereby incorporated by reference as if set forth in their entirety therein.

The invention as described hereinabove in the context of the preferred embodiments is not to be taken as limited to all of the provided details thereof, since modifications and variations thereof may be made without departing from the spirit and scope of the invention.

What is claimed is:

1. A method of marking objects, particularly related to banknote cassettes (1) or other valuable object storage spaces, said method comprising the steps of: placing a container (60) that can be punctured, slit, or otherwise opened adjacent said object/objects (100), said container having a length, a height, and a width, said length being greater than either of said height and said width; causing a slitting device (13) to be released from an inactive rest position in response to an alarm; moving said slitting device along a substantial portion of said length of said container, to slit open said container (60) to bring a content (61) of said container into contact with the object/objects (100) and therewith mark said object/objects and/or render said object/objects unusable.

2. The method according to claim 1, further comprising bringing said content directly into contact with said object/objects upon opening of said container.

3. The method according to claim 2, further comprising placing the container (60) in an upper region of the banknote cassette (1) so that the container content (61) will be brought into contact with said object/objects (100) at least partially by the force of gravity.

4. A device for marking objects, particularly objects housed in banknote cassettes (1) or any other valuable object storage spaces, said marking device (10) comprising a container (60) having a length, a height, and a width, said length being greater than either of said height and said width; which container being configured to be punctured, slit, or otherwise opened and which is placed adjacent said objects (100); and slitting means (13) being configured to be movable from an inactive starting position to an active terminal position along a substantial portion of the length of the container to slit open the container (60) when necessary, such as to enable contents (61) of the container to come into contact with said object/objects (100) and therewith mark said object/objects and/or render said object/objects useless.

5. The device according to claim 4, said device further comprising spring means (26) slitting means to move in a forward direction (A).

6. The device according to claim 4, wherein the device (10) includes a release mechanism (30) which is adapted to hold said slitting means in its inactive starting position; and in that said device includes means which eliminate the ability of the release mechanism (30) to hold said slitting means in said inactive starting position when an alarm is triggered.

7. The device according to claim 4, wherein the container (60) contains a liquid (61); the container (60) is made of plastic foil; and said device (10) includes means (80) for forcibly emptying the container (60) of its liquid content.

8. The use of the device according to claim 4, comprising using said device (10) in connection with at least one of: paying machines, automatic telling machines, and automatic cash dispensers, to drop-stain or spray-stain banknotes (100) or valuable objects.

9. The device according to claim 4, wherein said container is disposed adjacent said object/objects to permit said contents of said container to be moved directly into contact with said object/objects.

10. The device according to claim 9, wherein said slitting means (13) includes a cutting edge (15).

11. The use of the device according to claim 10, comprising using said device (10) in connection with at least one of: paying machines, automatic telling machines, and automatic cash dispensers, to drop-stain or spray-stain banknotes (100) or valuable objects.

12. The device according to claim 10, said device further comprising spring means (26) which exert force on said slitting means (13) such as to cause said slitting means to move in said forward direction (A).

13. The use of the device according to claim 12, comprising using said device (10) in connection with at least one of: paying machines, automatic telling machines, and automatic cash dispensers, to drop-stain or spray-stain banknotes (100) or valuable objects.

14. The device according to claim 12, wherein the device (10) includes a release mechanism (30) which is adapted to hold said slitting means in its inactive starting position; and in that said device includes means which eliminate the ability of the release mechanism (30) to hold said slitting means in said inactive starting position when an alarm is triggered.

15. The device according to claim 14, wherein the container (60) contains a liquid (61); the container (60) is made of plastic foil; and said device (10) includes means (80) for forcibly emptying the container (60) of its liquid content.

16. The use of the device according to claim 14, comprising using said device (10) in connection with at least one of: paying machines, automatic telling machines, and automatic cash dispensers, to drop-stain or spray-stain banknotes (100) or valuable objects.

* * * * *

UNITED STATES PATENT AND TRADEMARK OFFICE

CERTIFICATE OF CORRECTION

PATENT NO. : 6,564,726 B1
DATED : May 20, 2003
INVENTOR(S) : Kjell Lindskog

It is certified that error appears in the above-identified patent and that said Letters Patent is hereby corrected as shown below:

Column 1,
Line 20, after "carrying" delete "-".

Column 2,
Line 51, after "1", delete ";" and insert -- . --.

Column 8,
Line 49, after "as" delete ".".

Column 9,
Line 13, before "published", delete "073872" and insert -- 03872 --.

Signed and Sealed this

Second Day of September, 2003

JAMES E. ROGAN
*Director of the United States Patent and Trademark Office*